US006019404A

United States Patent [19]

Pasquale

[11] Patent Number: 6,019,404

[45] Date of Patent: Feb. 1, 2000

[54] HOISTING HARNESS FOR A FIREARM

[76] Inventor: Michael Pasquale, 40 Campground Rd., West Boylston, Mass. 01583

[21] Appl. No.: 09/205,891

[22] Filed: Dec. 4, 1998

[51] Int. Cl.[7] ..... F41C 33/00

[52] U.S. Cl. ..... 294/1.1; 294/150; 224/150

[58] Field of Search ..... 294/1.1, 74, 82.11, 294/165, 150, 166; 224/150, 149, 913, 257

[56] References Cited

U.S. PATENT DOCUMENTS

| | | | |
|---|---|---|---|
| 2,884,172 | 7/1959 | Kubo | 224/149 |
| 3,653,564 | 4/1972 | Carter | 224/913 |
| 4,280,644 | 7/1981 | Shindelka | 224/149 |
| 4,760,944 | 8/1988 | Hughes . | |
| 4,827,578 | 5/1989 | Heckerman et al. | 224/150 |
| 5,092,505 | 3/1992 | Olschlager | 224/150 |
| 5,388,877 | 2/1995 | Wenk . | |
| 5,575,411 | 11/1996 | Hightower | 224/149 |
| 5,655,803 | 8/1997 | Tacoronte . | |
| 5,810,219 | 9/1998 | Rosenfield | 224/149 |

*Primary Examiner*—Dean J. Kramer
*Assistant Examiner*—Paul T. Chin
*Attorney, Agent, or Firm*—Blodgett & Blodgett, P.C.

[57] ABSTRACT

A hoisting harness for a firearm that includes a harness assembly for attaching to the stock portion of the firearm, a cover for being placed over the muzzle end of the barrel portion of the firearm and an elastic cord connected to the cover and to the harness assembly for biasing the cover toward the stock. More specifically, the harness assembly includes a strap for wrapping around the stock, a fastener for releasably maintaining the strap on the stock and a connector fixed to the strap for attaching to the elastic cord and to a hoisting line.

5 Claims, 2 Drawing Sheets

HOISTING HARNESS FOR A FIREARM

BACKGROUND OF THE INVENTION

The present invention relates generally to a supporting harness for a firearm and, specifically, for a firearm harness which enables the firearm to be hoisted vertically to an elevated position such as a hunter's tree stand.

When a hunters uses a tree stand, he or she attaches a harness to the firearm and a hoist line to the harness. The hunter then climbs into the stand without the firearm but carrying the hoist line. After assuming a safe position in the tree stand, the hunter pulls the firearm up to the stand with the hoist line. Since the firearm is laying on the ground prior to hoisting up to the stand, prior art harness and hoisting devices support the firearm so that the muzzle end of the barrel is pulled up first. This prevents dirt or debris from getting into the barrel or otherwise nicking or scratching the muzzle end of the barrel. This also means that the muzzle of the firearm faces the hunter as the firearm is hoisted. Ideally, the firearm is not loaded during the hoisting procedure if the hunter is following standard safety practices. However, one of the primary safety rules is to never handle a firearm so that it is pointed at you, even if you believe the firearm to be "unloaded".

Protective caps have been developed for protecting the muzzle end of the barrel. However, the cap is likely to become separated from the barrel if the firearm is hoisted butt end first. Theses and other difficulties experienced with the prior art harness systems for firearms have been obviated by the present invention.

It is, therefore, a principal object of the present invention to prove a harness apparatus for a firearm which enables the firearm to be hoisted butt end first while protecting the muzzle end of the barrel.

A further object of the invention is the provision of a firearm harness which is simple in construction and easy to apply to and easy to remove from a firearm.

Another object of the invention is the provision of an efficient and relatively simple method of constructing and assembling a firearm harness which is capable of a long life of useful service.

With these and other objects in view, as will be apparat to those skilled in the art, the invention resides in the combination of parts set forth in the specification and covered by the claims appended hereto.

BRIEF SUMMARY OF THE INVENTION

In general, the invention consists of a hoisting harness for a firearm that includes a harness assembly for attaching to the stock portion of the firearm, a cover for being placed over the muzzle end of the barrel portion of the firearm and an elastic cord connected to the cover and to the harness assembly. More specifically, the harness assembly includes a strap for wrapping around the stock, fastening means for releasably maintaining the strap on the stock and a connector fixed to the strap for attaching to the elastic cord and to a hoisting line.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
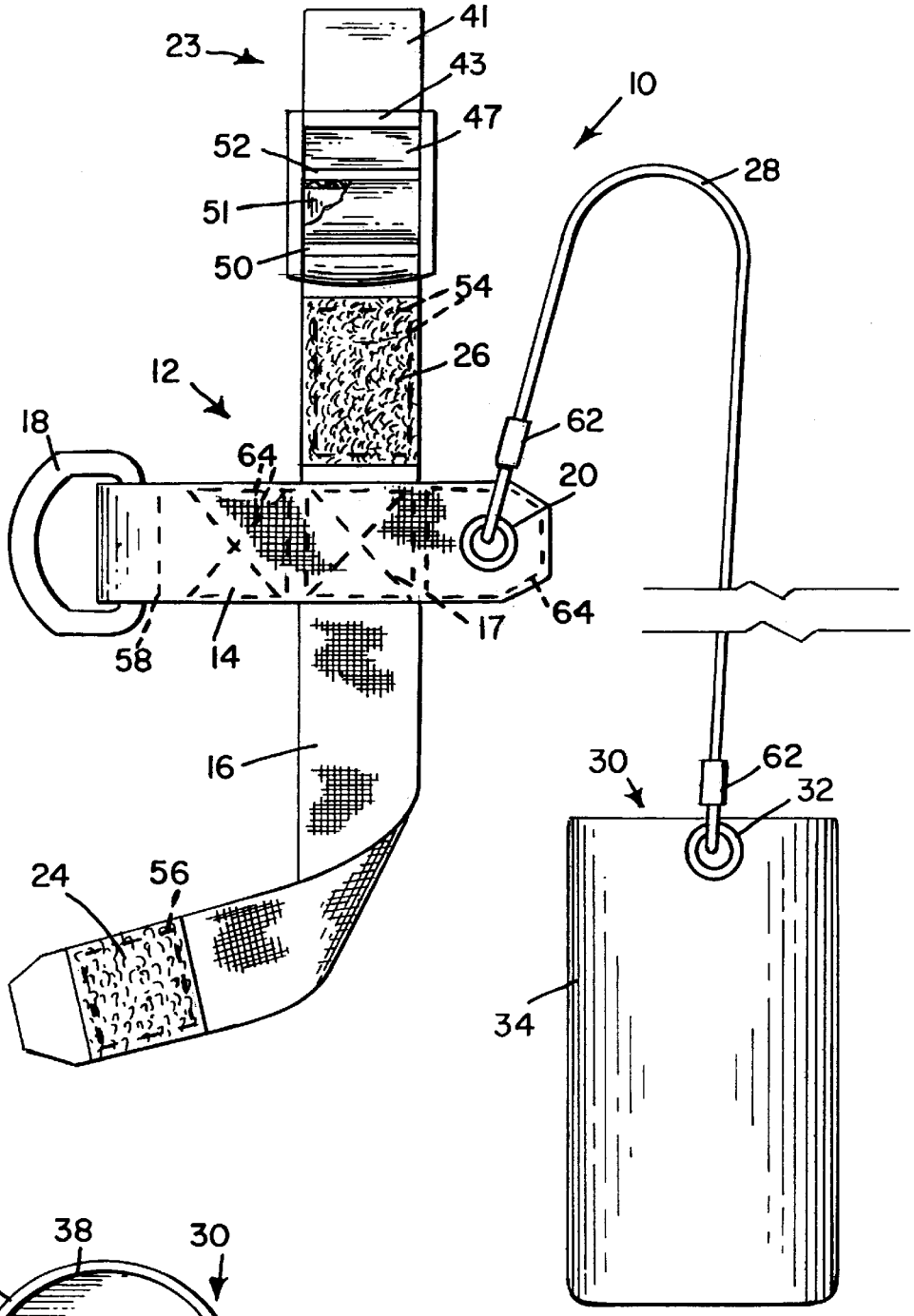
FIG. 1 is a plan view of a hoisting harness for a firearm embodying the principals of the present invention.
Figure 2:
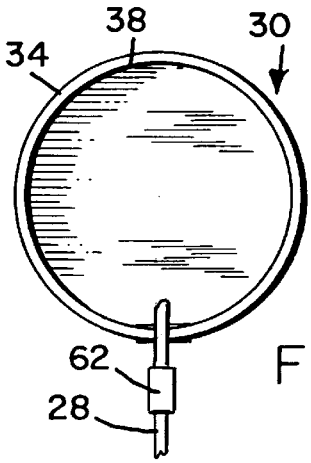
FIG. 2 is an end view of the open end of the cover portion of the hoisting harness of the present invention.

Referring first to FIGS. 1 and 2, the hoisting harness of the present invention is generally indicated by the reference numeral 10 and comprises a harness assembly, generally indicated by the reference numeral 12, a cover, generally indicated by the reference numeral 30, and an elastic cord 28 connected to the harness assembly 12 and the cover 30.

The harness assembly 12 includes a strap 16 and a connector 14 extending transversely of the strap 16. The connector 14 and the strap 16 are each made of heavy duty textile material fixed together, i.e. by stitching 17. One end of the connector 14 is secured to a rigid D-shaped loop 18. The opposite end of the connector 14 has an eyelet or grommet 20. One end of the strap 16 is secured to a buckle 22. The opposite end of the strap 16 has a first component 24 of a hook and loop fastener. The opposite side of the strap 16 has a second component 26 of a hook and loop fastener which is complementary to the first component 24. The second component 26 is located between the buckle 22 and a connector 14. The buckle 22 includes a pivoted locking clasp, generally indicated by the reference numeral 23. One end of the elastic cord 28 is secured to the eyelet 20. The opposite end of the cord 28 is secured to an eyelet or grommet 32 in the side wall 34 of the cover 30. One end of the cover 30 has an end wall 36. The opposite end of the cover 30 has an opening 38.

Figure 3:
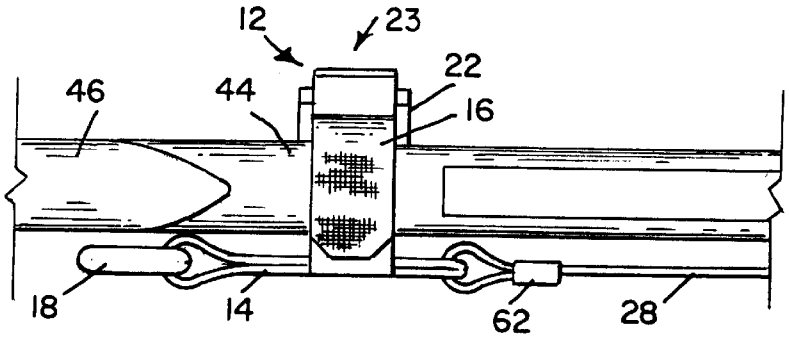
FIG. 3 is a top plan view of the hoisting harness of the present invention shown applied to a firearm, with portions broken away.
Figure 4:
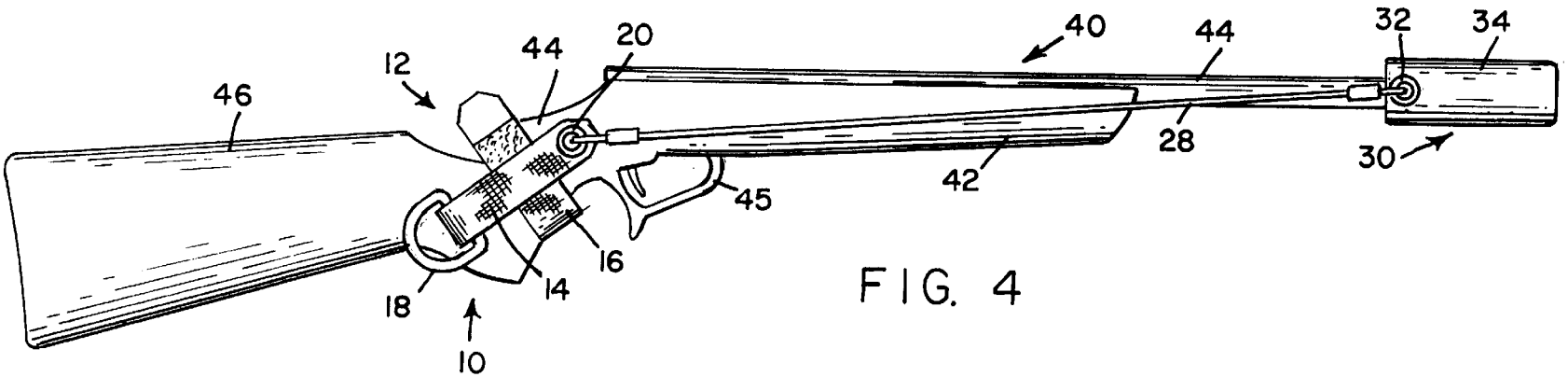
FIG. 4 is side elevational view of the hoisting harness applied to a firearm.

Referring to FIGS. 3 and 4, the hoisting harness 10 of the present invention is shown applied to a firearm, generally indicated by the reference numeral 40, which includes a stock 42, a barrel 44, and a trigger guard 45. The harness assembly 12 is applied to the narrow portion 44 of the stock between the butt end 46 of the stock and the trigger guard 45. The strap 16 is laid against one side of the narrow portion 44 and the free end of the strap is looped around the stock of the firearm and is then passed through an end opening, not shown, in the buckle 22 just below the clasp 23. The clasp 23 is a bell crank lever comprising a handle portion 41 and a pressing portion 43. The end of the strap 16 is locked in place by pivoting the handle portion 41 toward the buckle so that the pressing portion 43 squeezes the strap against the bottom wall 47 of the buckle. The hook and loop fastening component 24 is then pressed against the complimentary hook and loop fastening component 26 to secure the free end of the strap. With the strap 16 thus secured, the connector 14 is located outside of the strap 16, as shown in FIG. 4, with the eyelet 20 adjacent the barrel 44 while the loop 18 is adjacent the butt end 46 of the stock. The elastic cord 28 is extended by grasping the cover 30, and moving it away from the harness assembly and then placing the cover 30 over the muzzle end of the barrel 44. The elastic cord 28 biases the cover 30 toward the stock 42. This maintains the cover 30 in a protective secure position on the muzzle end of the barrel during subsequent handling of the firearm. Prior to climbing the tree to the stand, the hunter ties a hoist line through the loop 18. The hunter then climbs the tree to the stand while holding or carrying the other end of the hoist line. After reaching a secure position on the stand, the hunter pulls the hoist line upwardly. This lifts the firearm butt end first, since most of the weight of the firearm is forward of the loop 18. When the firearm has been retrieved by the hunter in the tree stand, the hoisting harness of the present invention is removed from the rifle. The harness assembly 12 is folded and stored within the cover 30 along with the elastic cord 28 to form a compact package which can easily be placed in the hunters pocket. The opening 38 of the cover 30 is large enough to receive the muzzle end of any conventional firearm, including rifles, shotguns, and muzzle loading firearms.

The hoisting harness of the present invention is made by extending one end of the strap 16 to a first opening 52 in the buckle 22 around a crossbar 51 and down through a second opening 58. The end of the strap 16 is then secured to a midportion of the strap 16 by stitching 54 while simultaneously stitching the hook and loop component 26 to the strap. The complimentary hook and loop fastening material 24 is fixed to the opposite end of the strap 16 and on the opposite side of the strap 16 by stitching 56.

The connector 14 is formed by extending a length of heavy duty textile strap material through the loop 18 and folding the textile strap onto itself so that it has a double thickness, as shown in FIG. 3. This can be done with a single fold or folded from each end so that the end edges abut. The connector 14 is positioned on the strap 16 so that the strap 16 extends between the two layers of the textile strap material which forms the connector 14, as shown in FIG. 1. The connector 14 is then restricted to the strap 16 by stitching 17. The loop 18 is secured to one end of the connector 14 by stitching 58. Eyelet or grommet 20 is secured to the opposite end of the connector 14 by punching a hole in the end of the connector and applying the eyelet 20 with a conventional eyelet inserting tool. Eyelet or grommet 32 is applied to the cover 30 in a like manner. One end of the cord 20 is inserted through the eyelet 20 and folded back onto itself and secured by a deformable metal crimp 60. The opposite end of the cord 28 is inserted through the eyelet 32 and folded back onto itself and secured by a metallic crimp 62. Preferably additional reinforcing stitching 64 is applied to the connector 14 on opposite side of the strap 16. Stitching is the preferred procedure for securing the strap to the hook and loop fastener components 24 and 26 and to the connector 14 as well as securing the layers of connector 14 to itself. However, adhesive may also be employed. For textile materials of synthetic fibers the components of harness 12 may also be secured by ultrasonic welding.

The steps of constructing the hoisting harness of the present invention do not necessarily have to be in the exact sequence described above.

Clearly minor changes may be made in the form or construction of this invention and in the embodiments of the process without departing from the material spirit of either. Therefore, it is not desired to confine the invention to the exact form shown herein and described, but it is desired to include all subject matter that will probably come within the scoped claimed.

The invention having been thus described, was claimed as new and desired and secured by Letters Patent:

What is claimed is:

1. A hoisting harness for a firearm having a stock and a barrel extending from the stock and terminating in a muzzle end, said hoisting harness comprising:

(a) a harness assembly for being removably attached to the stock of said firearm;

(b) a cover for being placed over the muzzle end of said firearm for protecting said muzzle end, said cover having a side wall, an end wall and an end opening opposite said end wall;

(c) an elastic cord having a first end connected to said harness assembly and a second end connected to said cover so that when said harness assembly is attached to said stock and said cover is placed over said muzzle end said cover is biased toward said harness assembly by said elastic cord and the bottom wall of said cover is drawn against the muzzle end of said barrel; and (d) a fixture secured to said harness assembly for attachment to a hoist line.

2. A method of constructing a hoisting harness for a firearm for enabling said firearm to be hoisted from the ground to a position vertically spaced from the ground, said method comprising the following steps:

(a) fixing an eyelet to one end of a first textile strap;

(b) fixing a rigid loop to the opposite end of said first textile strap;

(c) fixing said first textile strap transversely to a second textile strap;

(d) fixing a buckle to one end of said second textile strap;

(e) securing one end of an elastic cord to said eyelet; and (f) securing the opposite end of said elastic cord one end of a cover which is adapted to fit over the muzzle end of a firearm, said cover having an open end and a closed end and said elastic cord being secured to the open end of said cover.

3. A method of constructing a hoisting harness as recited in claim 2, further comprising the following steps:

(a) fixing a first component of a pair of complementary fastening means to one side of said second textile strap adjacent said buckle; and (b) fixing a second component of a said pair of complementary fastening components to the opposite side of said second textile strap at the end of said second textile strap which is opposite said buckle.

4. A hoisting harness for a firearm having a stock and a barrel extending from the stock and terminating in a muzzle end, said hoisting harness comprising:

(a) a harness assembly for being removably attached to the stock of said firearm, said harness assembly comprising:

(1) a strap for wrapping around the stock of said firearm;

(2) fastening means for releasably maintaining said strap on said stock; and (3) a connector fixed to said strap, said connector having a first free end and a second free end;

(b) a cover for being placed over the muzzle end of said firearm for protecting said muzzle end, said cover having a side wall, an end wall and an end opening opposite said end wall;

(c) an elastic cord having a first end connected to the first free end of said connector and a second end connected to said cover so that when said harness assembly is attached to said stock and said cover is placed over said muzzle end, said cover is biased toward said harness assembly by said elastic cord and the bottom wall of said cover is drawn against the muzzle end of said barrel; and (d) a fixture connected to the second free end of said connector for attachment to a hoist line.

5. A hoisting harness as recited in claim 4, wherein said strap has a first side and a second side opposite said first side, and said fastening means comprises:

(a) a buckle fixed to one end of the strap;

(b) a first fastening element on the first side of said strap adjacent said buckle; and (c) a second fastening element complementary to said first fastening element on the second side of said strap.

* * * * *